US010232643B2

(12) United States Patent
Ozawa

(10) Patent No.: US 10,232,643 B2
(45) Date of Patent: Mar. 19, 2019

(54) PRINTING APPARATUS, CONTROL METHOD AND COMPUTER READABLE RECORDING MEDIUM

(71) Applicant: CASIO COMPUTER CO., LTD., Shibuya-ku, Tokyo (JP)

(72) Inventor: Takeo Ozawa, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/882,011

(22) Filed: Jan. 29, 2018

(65) Prior Publication Data

US 2018/0215172 A1 Aug. 2, 2018

(30) Foreign Application Priority Data

Jan. 30, 2017 (JP) ..... 2017-014825

(51) Int. Cl.

| | |
|---|---|
| ***B41J 29/38*** | (2006.01) |
| ***B41J 11/00*** | (2006.01) |
| ***B41J 2/32*** | (2006.01) |
| ***B41J 3/407*** | (2006.01) |

(52) U.S. Cl.

CPC ..... *B41J 11/003* (2013.01); *B41J 2/32* (2013.01); *B41J 3/4075* (2013.01)

(58) Field of Classification Search

CPC . B41J 3/4075; B41J 11/003; B41J 2/32; B41J 2/3551

See application file for complete search history.

(56) References Cited

U.S. PATENT DOCUMENTS

| | | | | |
|---|---|---|---|---|
| 6,570,601 | B2 | 5/2003 | Jimbo | |
| 9,315,051 | B1 * | 4/2016 | Ozawa | B41J 3/4075 |

FOREIGN PATENT DOCUMENTS

| | | | |
|---|---|---|---|
| JP | 2000246980 | A | 9/2000 |
| JP | 2002137432 | A | 5/2002 |
| JP | 2002283604 | A | 10/2002 |
| JP | 2011230428 | A | 11/2011 |
| JP | 6036892 | B2 | 11/2016 |

* cited by examiner

*Primary Examiner* — Huan Tran

(74) *Attorney, Agent, or Firm* — Holtz, Holtz & Volek PC

(57) ABSTRACT

A printing apparatus includes a print head configured to perform printing on a print medium line by line based on print data, a drive motor configured to convey the print medium in accordance with printing of the print data on the print medium, a processor, and a width detecting unit configured to detect a width information of the print medium. In a case where printing is restarted after printing on the print medium by the print head is paused, the processor controls a rotation direction of the drive motor to be a reverse direction opposite to a direction before the pause of the printing and determines a rotation amount of the reverse rotation according to the width information of the print medium detected by the width detecting unit.

7 Claims, 8 Drawing Sheets

FIG. 7

| TAPE WIDTH \ THE NUMBER OF STEPS | 0 | 2 | 4 | 8 | 10 |
|---|---|---|---|---|---|
| 24 ~ 46 mm | × | △ | ○ | ○ | ○ |
| 12 ~ 18 mm | × | × | △ | ○ | ○ |
| 3.5 ~ 9 mm | × | × | × | △ | ○ |

| THE NUMBER OF DIVISIONS \ THE NUMBER n OF STEPS | 0 | 2 | 4 |
|---|---|---|---|
| 3 | ○ | ○ | ○ |
| 1 OR 2 | △ | ○ | ○ |

PRINTING APPARATUS, CONTROL METHOD AND COMPUTER READABLE RECORDING MEDIUM

CROSS-REFERENCE TO RELATED APPLICATION

This application is based upon and claims the benefit of priority from Japanese Patent Application No. 2017-014825, filed on Jan. 30, 2017, the entire contents of which are incorporated herein by reference.

BACKGROUND OF THE INVENTION

The present invention relates to a printing apparatus, a control method and a computer readable recording medium.

DESCRIPTION OF THE RELATED ART

There have been known a tape printer for printing character strings on a tape-like recording sheet to generate a label to be attached to various goods.

Such a tape printer includes a cassette mounting part where a cassette containing a tape as a print medium can be mounted. The cassette mounting part is provided with a thermal head for performing printing on a tape, a platen roller for conveying the tape with the tape interposed between the platen roller and the thermal head, a cutter for cutting the printed tape.

The tape printer sometimes pauses printing during printing in order to perform certain processes. For example, such pausing is performed when it is necessary to cut a tape in order to secure a set margin in front of a character string to be printed, when cooling of the thermal head is necessary in order to perform appropriate printing control since the temperature of the thermal head has excessively risen during printing, when it is necessary to perform a print data developing process during printing, and the like.

When pausing printing, in order to prevent a tape from shifting during a predetermined process, driving of a driving motor for the thermal head and the platen roller is stopped with the platen roller held at a print position. Then, once the predetermined process finishes, the driving motor for the thermal head and the platen roller is controlled to restart the printing.

However, in a tape printer including a platen roller movable with respect to a thermal head and driving means for the platen roller as described above, there is a case where a tape is conveyed even during print pausing, resulting in print omission.

For this problem, there has been known technique for preventing print omission by rotating a drive motor in a reverse direction by a constant angle when printing is paused (for example, JP-A-2000-246980).

Further, there has been known technique for preventing print omission by rotating a drive motor in a reverse direction according to conditions such as a pattern (state) of print data, whether it is necessary to cut a tape when printing is paused, and a relation between duration of pause of printing and a head temperature (for example, JP-B-6036892).

However, even applying the above techniques, print omission may be caused in some patterns of print data and some conditions of printing operations.

BRIEF SUMMARY OF THE INVENTION

Accordingly, the present invention provides a printing apparatus capable of suppressing print omission due to case other than patterns of print data and conditions for printing operations, and a control method and a control program of the printing apparatus.

According to an embodiment of the present invention, there is provided a printing apparatus including: a print head configured to perform printing on a print medium line by line based on print data; a drive motor configured to convey the print medium in accordance with printing of the print data on the print medium; a processor; and a width detecting unit configured to detect width information of the print medium. In a case where printing is restarted after printing on the print medium by the print head is paused, the processor controls a rotation direction of the drive motor to be a reverse direction opposite to a direction before the pause of the printing and determines a rotation amount of the reverse rotation according to the width information of the print medium detected by the width detecting unit.

According to another embodiment of the present invention, there is provided a printing apparatus including: a print head configured to perform printing on a print medium line by line based on print data; a drive motor configured to convey the print medium in accordance with printing of the print data on the print medium; and a processor. In a case of performing printing on the print medium line by line by the print head, the processor controls the print head to perform printing of one line based on the print data while dividing the printing by a plurality of times. While in a case where printing is restarted after printing on the print medium by the print head is paused, the processor controls a rotation direction of the drive motor to be a reverse direction opposite to a direction before the pause and determines a rotation amount of the reverse rotation according to a number of divisions of printing of the one line.

According to a further embodiment of the present invention, there is provided a control method of a printing apparatus which includes a print head configured to perform printing on a print medium line by line based on print data, a drive motor configured to convey the print medium in accordance with printing of the print data on the print medium, a processor, and a width detecting unit configured to detect width information of the print medium. The method includes in a case where printing is restarted after printing on the print medium by the print head is paused, controlling by the processor a rotation direction of the drive motor to be a reverse direction opposite to a direction before the pause of the printing, and determining by the processor a rotation amount of the reverse rotation according to the width information of the print medium detected by the width detecting unit.

According to a still further embodiment of the present invention, there is provided a non-transitory computer-readable recording medium storing a program, which is executable by a computer of a printing apparatus including a head configured to perform printing on a print medium line by line based on print data for printing on the medium, a drive motor configured to convey the print medium in accordance with printing of the print data on the print medium, and a width detecting unit configured to detect width information of the print medium, the program when executed by the computer, causes the computer to: in a case where printing is restarted after printing on the print medium by the print head is paused, control a rotation direction of the drive motor to be a reverse direction opposite to a direction before the pause of the printing, and determine a rotation amount of the reverse rotation according to the width information of the print medium detected by the width detecting unit.

According to the above configuration, the printing apparatus, the control method and the control program of the printing apparatus are capable of suppressing print omission due to case other than patterns of print data and conditions for printing operations.

BRIEF DESCRIPTION OF THE SEVERAL VIEWS OF THE DRAWING

FIG. 7 is an explanatory view of detailed processing of a motor reversing process according to the first embodiment.

DETAILED DESCRIPTION OF THE INVENTION

Hereinafter, embodiments of the present invention will be described in detail with reference to the accompanying drawings. A first embodiment of the present invention is configured to control the number of steps (rotation amount) during reverse rotation according to a tape width of a printing apparatus. A second embodiment of the present invention is configured to control the number of steps (rotation amount) during reverse rotation according to a tape width of a printing apparatus and the number of print divisions of each line during printing.

Figure 1:
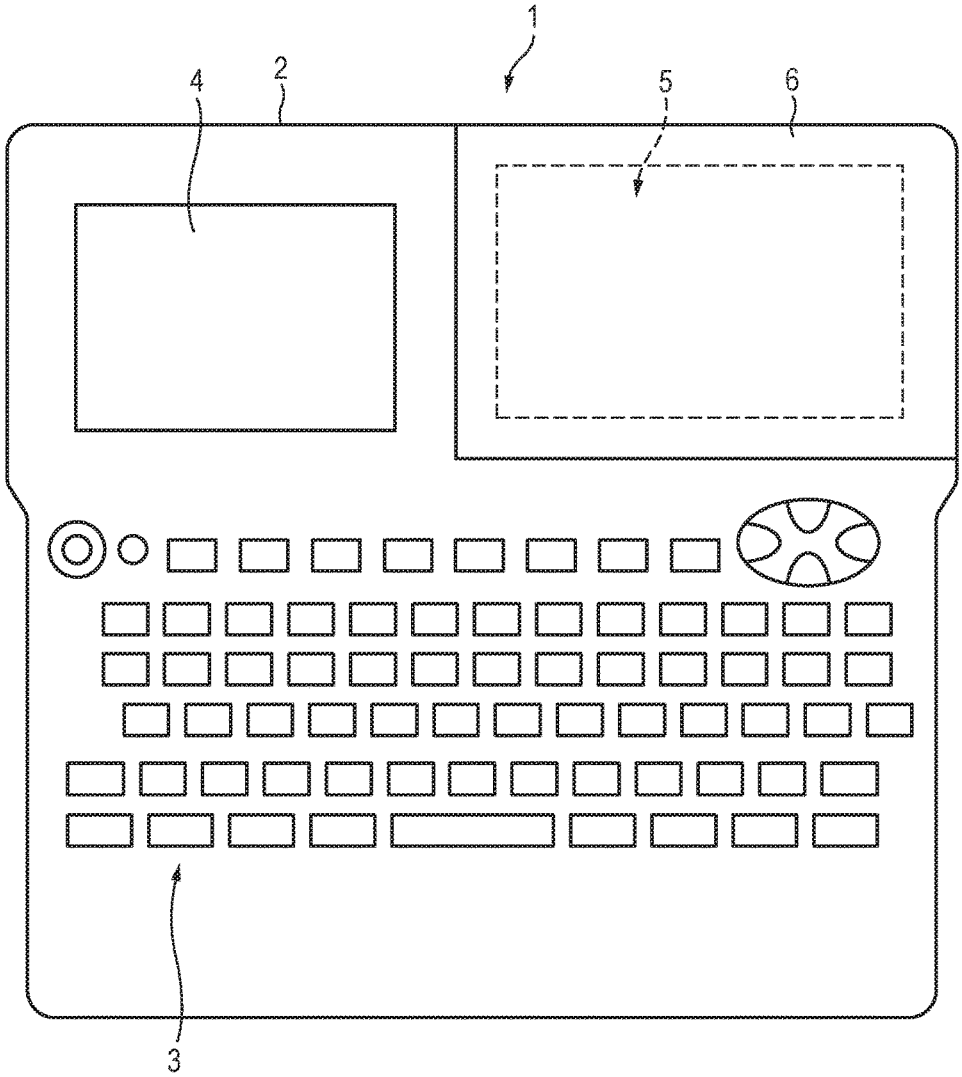
FIG. 1 is a plan view of a printing apparatus common to first and second embodiments of the present invention.
Figure 2:
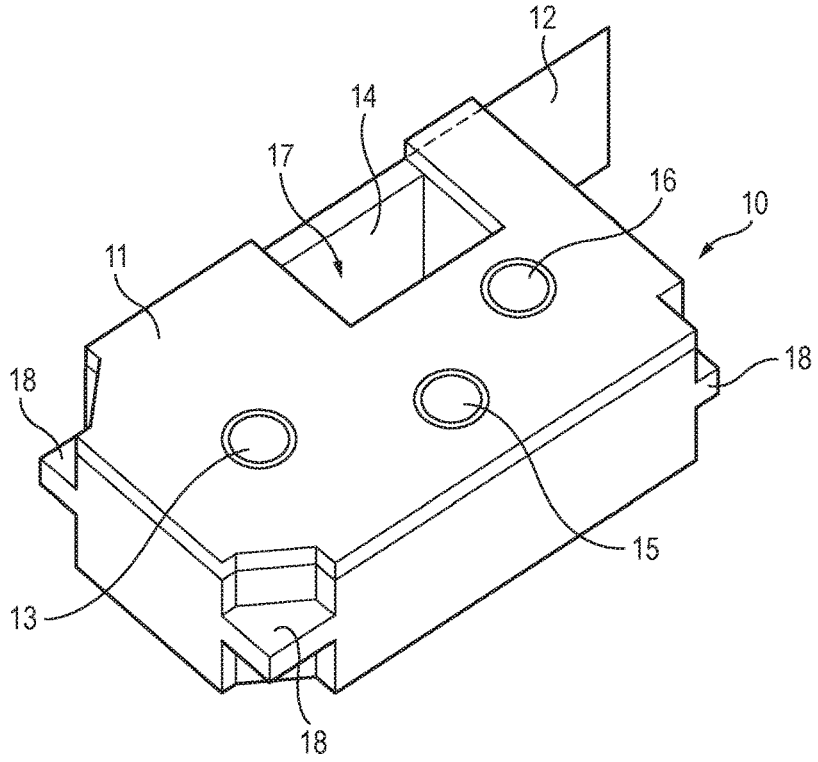
FIG. 2 is a perspective view of a tape cassette which is used in the printing apparatus.
Figure 3:
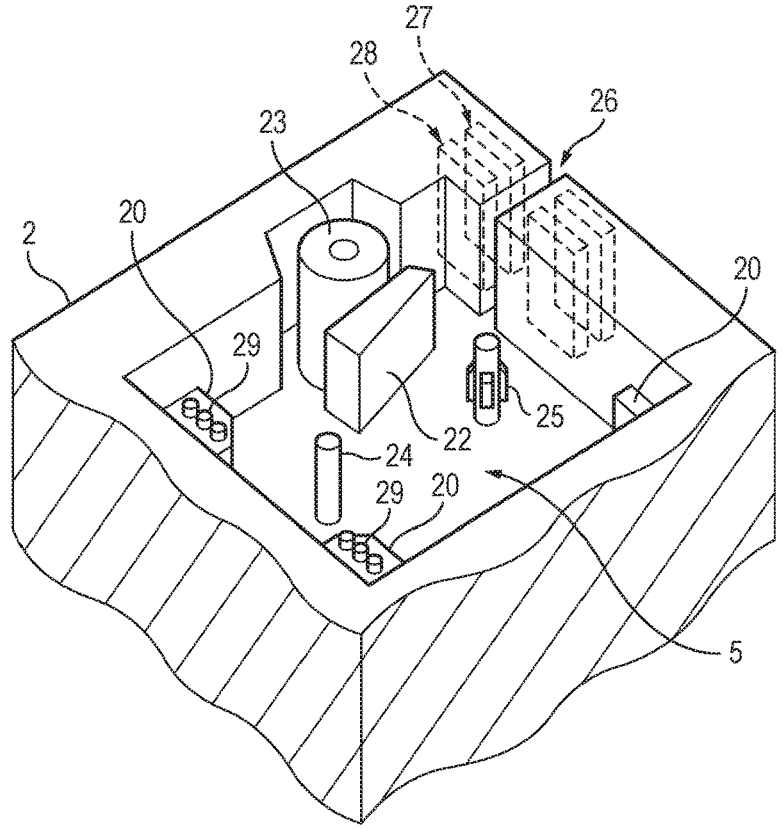
FIG. 3 is a perspective view of a tape cassette storage part of the printing apparatus.

FIG. 1 is a plan view of a printing apparatus 1 common to the first and second embodiments of the present invention, and FIG. 2 is a perspective view of a tape cassette 10 which is used in the printing apparatus 1, and FIG. 3 is a perspective view of a tape cassette storage part 5 of the printing apparatus 1. The printing apparatus 1 performs printing on a medium having a roll shape and having an adhesive layer on a rear surface thereof and can be used to print information such as names on a medium to generate a label and the like.

As shown in FIG. 1, the printing apparatus 1 includes a keyboard input unit 3 and a display unit 4 installed on an upper surface of a housing 2, and the tape cassette storage part 5 provided in the housing 2. The tape cassette storage part 5 has an opening formed in the upper surface of the housing 2 and is covered by an openable cover 6. Although not shown in the drawings, the housing 2 has a power cord connection terminal, an external device connection terminal, a storage medium insertion slot, and the like.

The keyboard input unit 3 has input keys for inputting a variety of data such as characters, cursor keys for moving a cursor on the display unit 4, keys for setting various modes, a key for performing a set mode, and the like. The keyboard input unit 3 functions as an input means.

The display unit 4 includes, for example, a liquid crystal display panel. The display unit 4 displays thereon operation procedure messages for a user of the printing apparatus 1, a variety of input information input from the keyboard input unit 3, selection menus for various options, information on selected options, print images, and the like.

The printing apparatus 1 uses, as a print medium, a print tape having a print surface and an adhesive surface as a front surface and a rear surface, respectively, and having a peelable tape attached to the adhesive surface. Hereinafter, such medium will be referred to as a print tape. Such a print tape is stored in the tape cassette 10 shown in FIG. 2.

As shown in FIG. 2, the tape cassette 10 includes a cassette case 11 containing a tape core 13 having a print tape 12 wound thereon, an ink ribbon supply core 15 having an ink ribbon 14 wound thereon, and an ink ribbon winding core 16.

As shown in FIG. 2, the cassette case 11 includes a print head insertion part 17 formed in a recess shape from one side surface of the cassette case 11. The ink ribbon 14 is unwound from the ink ribbon supply core 15 and is guided to pass through a part of the inside of the print head insertion part 17 close to the side surface by a guide means (not shown in the drawings) installed inside the cassette case 11, and then is wounded around the ink ribbon winding core 16.

The print tape 12 may be a paper tape, a resin tape, a magnet tape, or the like having an adhesive surface as the opposite surface to the print surface and having a peelable tape attached to the adhesive surface. The print tape 12 has the same width as that of the ink ribbon 14. The print tape 12 is unwound from the tape core 13 and is guided to pass through the print head insertion part 17 with the print surface facing the outer surface of the ink ribbon 14 by the guide means, and protrudes from a tape exit slot (not shown in the drawings) formed in the cassette case 11.

Meanwhile, as shown in FIG. 3, the tape cassette storage part 5 of the housing 2 has a plurality of cassette receiving parts 20 for supporting the tape cassette 10 at a predetermined position.

The tape cassette storage part 5 includes a print head 22, a platen roller 23, a tape core engagement shaft 24 to be engaged with the tape core 13 of the tape cassette 10, and an ink ribbon winding drive shaft 25 to be engaged with the ink ribbon winding core 16 of the tape cassette 10.

The cassette receiving parts 20 are formed corresponding to engagement parts 18 formed at a plurality of corners of the cassette case 11, and the tape cassette 10 is set at the predetermined position in the tape cassette storage part 5 by inserting the print tape 12 and the part of the ink ribbon 14 exposed to the inside of the print head insertion part 17 between the print head 22 and the platen roller 23, and engaging the tape core 13 and the ink ribbon winding core 16 with the tape core engagement shaft 24 and the ink ribbon winding drive shaft 25, respectively, and engaging the engagement parts 18 with the cassette receiving parts 20.

In FIG. 3, the print head 22 is inserted into the print head insertion part 17 of the tape cassette 10 and is pressed against the ink ribbon 14 during start of printing. The platen roller 23 is disposed to face the print surface of the print head 22 and intermittently conveys the ink ribbon 14 and the print tape 12 interposed therebetween the platen roller 23 and the print tape 12 in the length direction of the print tape 12 at a predetermined pitch. The platen roller 23 is intermittently rotated at the predetermined pitch by a stepping motor 38 shown in FIG. 4 to be described below, and the ink ribbon winding drive shaft 25 is rotated in synchronization with tape conveyance of the platen roller 23 by the stepping motor 38. Here, the print head 22 and the stepping motor 38 are controlled via a print head drive circuit 37 and a motor drive circuit 39 shown in FIG. 4 (to be described below), respectively, based on printing control data generated by a control unit 30 shown in FIG. 4 to be described below.

In the first and second embodiments, the ink ribbon 14 is a thermal transfer type ink ribbon, and the print head 22 is a thermal head having a predetermined number of dot-shaped heating elements arranged in a line along the longitudinal direction, i.e. the width direction of the ink ribbon 14 and the print tape 12. The print head drive circuit 37 drives heating elements of the heating element line corresponding to print data supplied to the print head 22 at timings when the ink ribbon 14 and the print tape 12 which are intermittently conveyed are stopped, whereby the print head 22 transfers ink of the ink ribbon 14 to the print tape 12. Accordingly, the print head drive circuit 37 drives the print head 22 based on print data generated by the control unit 30, whereby the print head operates as a head performing printing on the print tape 12 (a medium) line by line.

The tape cassette storage part 5 includes a tape discharge part 26 for discharging the printed part of the print tape 12 to the outside of the housing 2 which is conveyed as printing proceeds, and a full-cutting mechanism 27 and a half-cutting mechanism 28 for cutting the printed part of the print tape 12 i.e. the printed piece (for example, each label) from the print tape 12. The full-cutting mechanism 27 and the half-cutting mechanism 28 are installed at the tape discharge part 26 to be selectable and are driven by a tape cut motor 40 shown in FIG. 4 to be described below. Here, the tape cut motor 40 is controlled via a cut motor drive circuit 41 based on printing control data generated by the control unit 30.

The full-cutting mechanism 27 performs a full cutting operation of cutting both of the print tape 12 and the peelable tape. In the case where the full-cutting mechanism 27 is selected, a printed part is discharged as a printed piece with the peelable tape. The half-cutting mechanism 28 performs a half cutting operation of cutting the print tape 12 without cutting the peelable tape. In the case where the half-cutting mechanism 28 is selected, a printed part can be taken out by peeling it from the peelable tape connected to the tape cassette 10 stored in the housing 2, or can be taken out as a printed piece with the print tape by operating the full-cutting mechanism 27 at an appropriate timing and cutting the peelable tape.

Incidentally, there are a plurality of types of tape cassettes 10 different from one another in the widths of print tapes 12 and ink ribbons 14, and in order to obtain printed pieces having a desired size, a tape cassette according to the corresponding size can be set in the tape cassette storage part 5.

To this end, in the first and second embodiments, as the print head 22, a head having a print width (a heating-element array length) corresponding to the largest tape width of various tape widths is used, and according to the tape width of a tape cassette 10 set in the tape cassette storage part 5, some heating elements of the heating elements of the heating-element array included in an effective range corresponding to the width of the print tape 12 are driven.

Further, in the first and second embodiments, on surfaces of the engagement parts 18 of the cassette case 11 to be engaged with the cassette receiving parts 20, irregular parts for identification (not shown in the drawings) are formed depending on the type of the tape cassette 10, and on the cassette receiving parts 20 of the tape cassette storage part 5, tape width detection switches (width detecting units) 29 are installed so as to automatically determine the type of the tape cassette 10, i.e. the tape width of the print tape 12 (the width of a medium) and set an effective range of the print tape 12.

Figure 4:
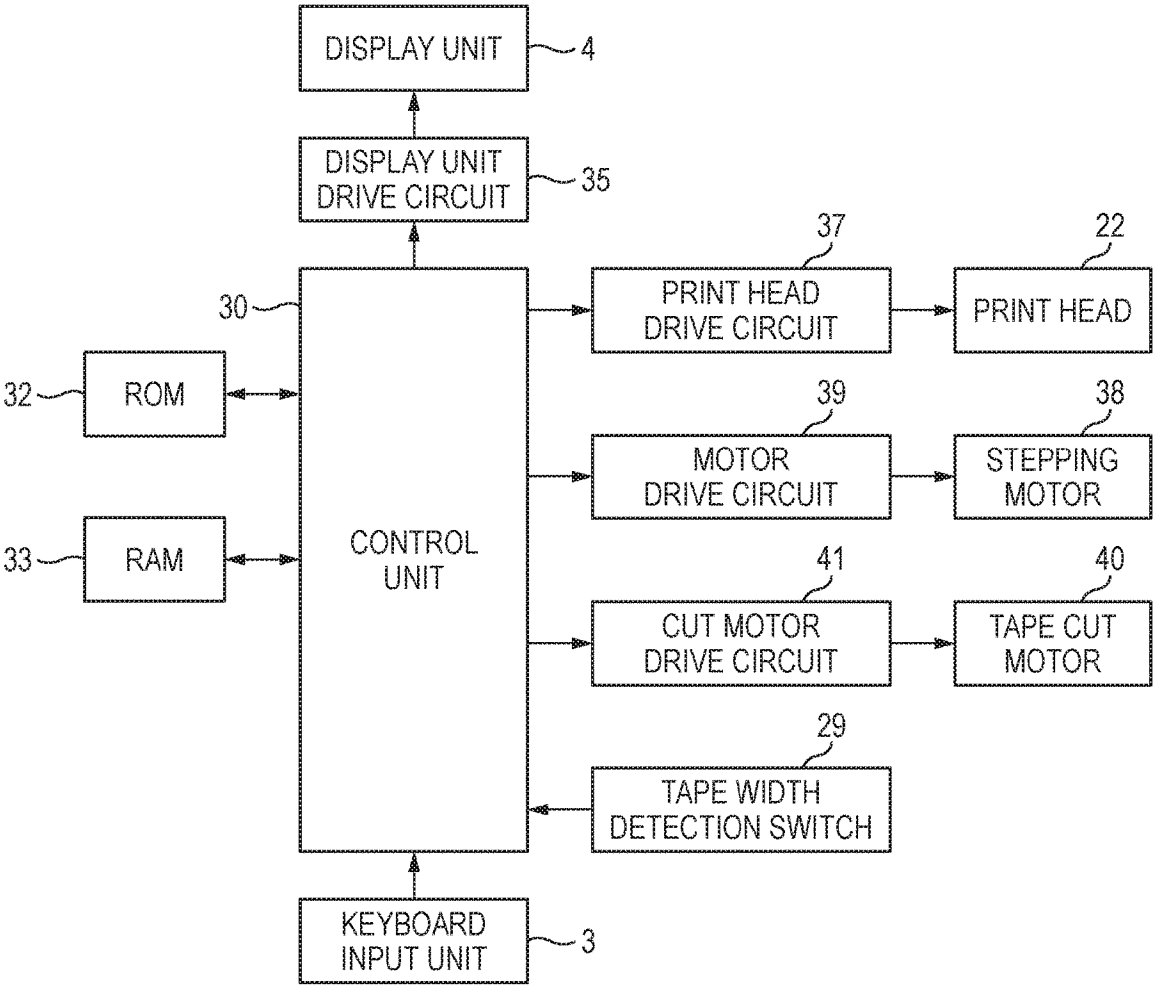
FIG. 4 is a block diagram of the printing apparatus.

FIG. 4 is a block diagram of the printing apparatus 1. The printing apparatus 1 includes the print head 22 (see FIG. 3), the print head drive circuit 37 configured to drive the print head 22, the stepping motor 38, the motor drive circuit 39 configured to drive the stepping motor 38, the tape cut motor 40, the cut motor drive circuit 41 configured to drive the tape cut motor 40, and the tape width detection switches 29. Also, the printing apparatus 1 includes the display unit 4 (see FIG. 1), a display unit drive circuit 35 configured to drive the display unit 4, and the keyboard input unit 3 (see FIG. 1). Further, the printing apparatus 1 includes the control unit 30, a ROM 32, and a RAM 33.

The display unit drive circuit 35 displays information on inputs from the keyboard input unit 3, selection menus for various options, messages related to a variety of processing, and the like on the display unit 4 according to instructions based on display control data generated by the control unit 30.

The stepping motor 38 rotates the platen roller 23 and the ink ribbon winding drive shaft 25 as described in the description of FIG. 3. The stepping motor 38 operates as a drive motor which rotates in one direction as print data is printed on the print tape 12 (a medium) to convey the print tape 12 along a predetermined direction. Also, while printing of print data on the print tape 12 is paused, the stepping motor 38 can perform an operation of rotating in a reverse direction to the one direction which is the direction of rotation before the pause when necessary (to be described below). The stepping motor 38 is controlled via the motor drive circuit 39 according to instructions based on printing control data generated by the control unit 30.

The tape cut motor 40 is a common motor for driving the full-cutting mechanism 27 and the half-cutting mechanism 28 described in the description of FIG. 3 and is installed to be engaged with one of the full-cutting mechanism 27 and the half-cutting mechanism 28 and be disengaged from the other. The tape cut motor 40 drives one cutting mechanism selected from the full-cutting mechanism 27 and the half-cutting mechanism 28. The tape cut motor 40 is controlled via the cut motor drive circuit 41 according to instructions based on printing control data generated by the control unit 30.

In the ROM 32, a system program, programs for processing a variety of pattern data of characters and the like defined in JIS codes and input data, a display program, a printing program, and the like are registered in advance. These programs may be read and stored from a storage medium such as a memory card inserted in the storage medium insertion slot (not shown in the drawings) of the printing apparatus 1, or an external device such as a personal computer connected to the external device connection terminal.

The control unit 30 is, for example, a micro processor, and activates the programs such as the system program stored in the ROM 32, according to inputs based on user's operations on keys of the keyboard input unit 3, and uses the RAM 33 as a work memory to receive inputs based on user's operations on keys of the keyboard input unit 3 and tape width detection signals from the tape width detection switches 29. The control unit 30 operates as a print data generating unit for generating print data to be printed on the print tape 12 (a medium). Further, the control unit 30 operates as a printing-control-data generating unit for generating printing control data for controlling the print head 22, the stepping motor 38, and the tape cut motor 40 via the print head drive circuit 37, the motor drive circuit 39, and the cut motor drive circuit 41, respectively. Furthermore, the control unit 30 operates a display control unit for controlling the display unit 4 via the display unit drive circuit 35. Moreover, the control unit 30 operates as a reverse-rotation control unit for controlling the stepping motor 38 via the motor drive circuit 39.

The RAM 33 temporarily stores input data from the keyboard input unit 3 and a touch panel 7, display data, print data, printing control data, a variety of data such as pattern data of characters and the like, display data, and print data read from the ROM 32 by the control unit 30, and the like.

Next, a printing process of the printing apparatus 1 common to the first and second embodiments will be described.

The printing apparatus 1 sometimes pauses printing in order to perform a predetermined process during printing. For example, such pausing may be performed when it is necessary to cut both of the print tape 12 and the peelable tape by the full-cutting mechanism 27, or when it is necessary to cut only the print tape 12 by the half-cutting mechanism 28 without cutting the peelable tape, as described above in the description of FIG. 3. Also, such pausing may be performed when cooling of the thermal head is necessary in order to perform appropriate printing control since the temperature of the thermal head has excessively risen during printing, or when it is necessary to perform a print data developing process during printing, and the like. However, the predetermined process is not limited to those examples, and may be other processes as long as it is necessary to pause printing in order to perform the corresponding processes. In the case of pausing printing, in order to prevent the print tape 12 from shifting during the predetermined process, in FIG. 4, the control unit 30 stops driving of the print head 22 by the print head drive circuit 37 and rotating of the platen roller 23 by the stepping motor 38, with the platen roller 23 (see FIG. 3) held at the print position. Then, if the predetermined process finishes, the control unit 30 controls the print head drive circuit 37 and the motor drive circuit 39 to restart the printing.

Figure 5B:
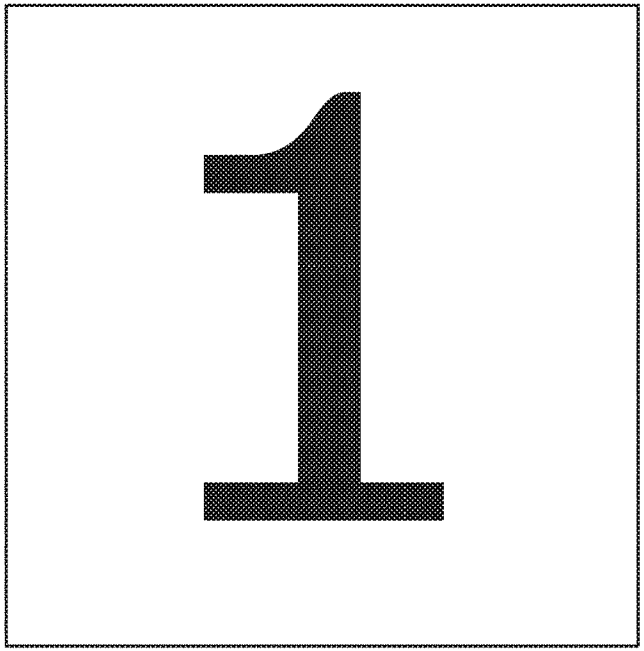
FIGS. 5A and 5B are explanatory views of the first and second embodiments.
Figure 5A:
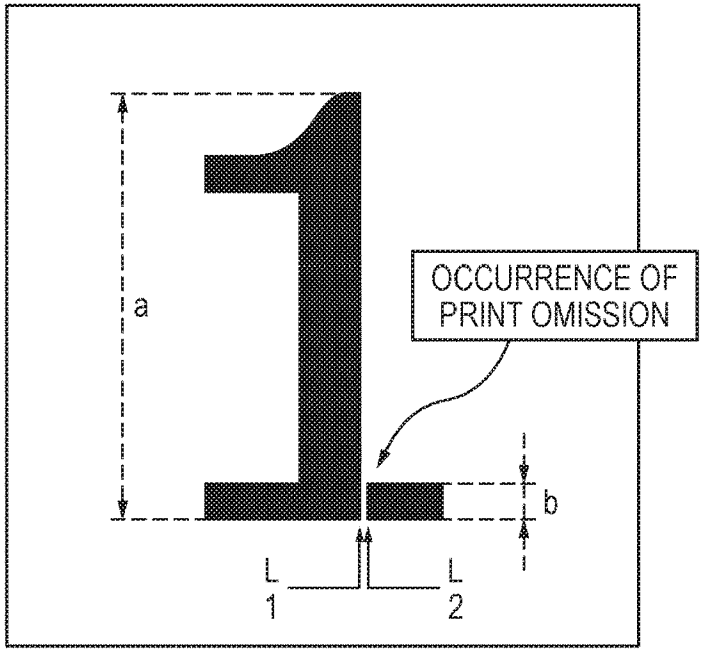

However, when printing is paused, print omission may occur, for example, as shown in FIG. 5A. Therefore, in each embodiment to be described below, when control for pausing printing is performed, a process of rotating the print tape 12 in the reverse direction based on print data is performed so as to perform printing without causing print omission, for example, as shown in FIG. 5B. As one of causes of print omission, it can be considered that the print tape 12 is conveyed when control for pausing printing is performed, and various other factors which cause print omission interacting with one another can be considered.

Figure 6:
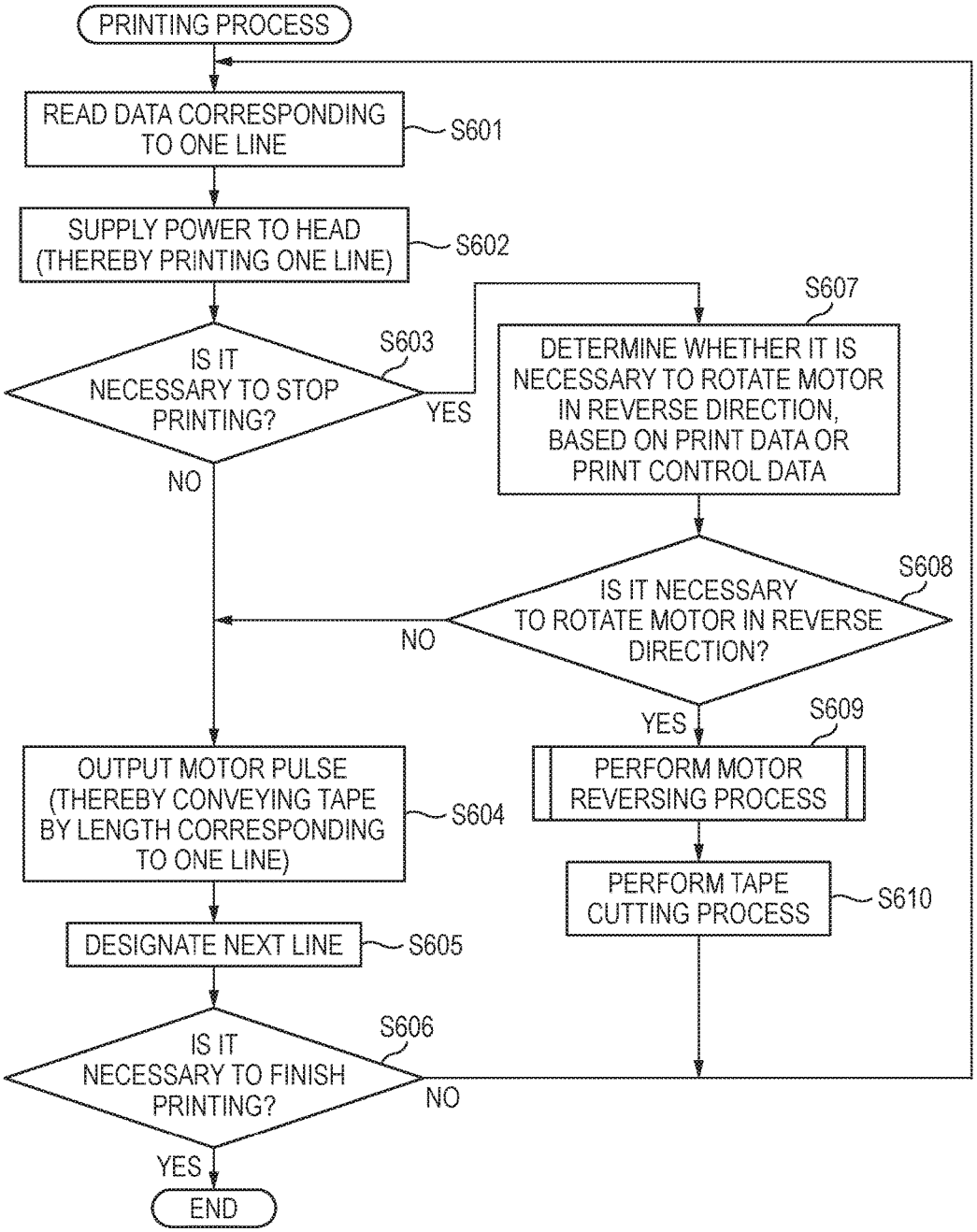
FIG. 6 is a flow chart illustrating a printing process common to the first and second embodiments.

FIG. 6 is a flow chart illustrating a printing process which is common to the first and second embodiments and is performed by the control unit 30 of FIG. 4. This process is an operation which is performed when the control unit 30 executes a printing processing program stored in the ROM 32. In the following description, FIG. 1 to FIG. 4 will be appropriately referred to.

First, the user inputs data to be printed and sets the format including the character size and margin lengths by operating the keyboard input unit 3, and operates a print key. As a result, pattern data corresponding to character data input from the keyboard input unit 3 is read out from the ROM 32 and is developed in a print data area of the RAM 33. In this specification, the character data include data of genuine characters. However, the character data is not limited thereto and may include a variety of types of data which can be printed on media by the printing apparatus of the present invention, such as numbers and symbols other characters, and various designs. In the case where the data amount of print data to be developed is large, all of designated print data cannot be developed in the RAM 33 at one time. In this case, the control unit 30 develops and prints the print data by dividing in a plurality of times while pausing printing as appropriate.

Subsequently, the control unit 30 rotates the stepping motor 38 in a normal direction via the motor drive circuit 39. Accordingly, the platen roller 23 is moved to the print position where it comes into pressure contact with the print head 22.

Thereafter, the control unit 30 starts to perform the printing process illustrated by the flow chart of FIG. 6.

First, the control unit 30 reads print data corresponding to one line, from the print data area of the RAM 33 (STEP S601). The print data of the corresponding line is data designating some heating elements to be subjected to power supply for printing from among the predetermined number of dot-shaped heating elements of the print head 22.

Subsequently, the control unit 30 supplies power to one or more heating elements designated from among the predetermined number of dot-shaped heating elements of the print head 22 by the print data of the corresponding line read in STEP S601, based on the print data of the corresponding line, via the print head drive circuit 37, thereby printing the corresponding line (STEP S602).

Subsequently, the control unit 30 determines whether to stop the printing operation for the above-mentioned predetermined process (STEP S603).

If determining not to stop the printing operation ("NO" in STEP S603), the control unit 30 outputs a motor pulse signal for normal rotation to the stepping motor 38 via the motor drive circuit 39 to convey the print tape 12 by a normal rotation method (STEP S604).

Thereafter, the control unit 30 designates the next line (STEP S605).

The control unit 30 determines whether a printing finish position has been reached as the result of next-line designation of STEP S605 (STEP S606).

If determining that the printing finish position has not been reached ("NO" in STEP S606), the control unit 30 returns to the process of STEP S601 and performs a process of printing the next line.

If the control unit 30 determines to stop the printing operation ("YES" in STEP S603), first, the control unit 30 determines whether to rotate the stepping motor 38 in the reverse direction based on the print data or printing control data (STEPS S607 and S608).

In the case where the control unit 30 determines not to perform reverse rotation as the result of determination of STEP S607 ("NO" in STEP S608), the control unit proceeds to the process of STEP S604 described above.

Meanwhile, in the case where the control unit 30 determines to perform reverse rotation, as the result of determination of STEP S607 ("YES" in STEP S608), the control unit 30 performs a motor reversing process of rotating the stepping motor 38 in the reverse direction based on the printing control data via the motor drive circuit 39 (STEP S609). Details of this process will be described below.

Subsequently, the control unit 30 drives the tape cut motor 40 via the cut motor drive circuit 41 based on the printing control data to operate the full-cutting mechanism 27 or the half-cutting mechanism 28 (see FIG. 3), and performs a process of cutting the print tape 12 by full cutting or half cutting described above in the description of FIG. 3 (STEP S610), Thereafter, the control unit 30 returns to the process of STEP S601 and performs a one-line printing process.

If the control unit 30 determines that the printing finish position has been reached ("YES" in STEP S606), the control unit 30 finishes the flow chart of FIG. 6 and finishes the printing operation.

In the printing process common to the first and second embodiments described above, when printing is stopped, the stepping motor 38 is rotated in the reverse direction based on the print data. In this case, if reverse rotation is performed by the same amount every time printing is stopped, print omission may occur. Specifically, for example, as shown in FIG. 5A, in the case where the number of dots "a" in a character data part of a line L1 which is a line immediately before stop of printing is large, and the number of dots "b" in a character data part of a line L2 which is a line which is the next line of the line L1 and is a line immediately after restart of printing is small (hereinafter, referred to as a first condition for the purpose of simplification), if reverse rotation is performed in the same way as that in the case where the number of dots "a" is relatively small, or the number of dots "b" is relatively large (hereinafter, referred to as a second condition for the purpose of simplification), print omission may occur more easily. Conversely, in the case where the above-mentioned second condition is satisfied, if reverse rotation is performed, it is possible to suppress print omission. In other words, if reverse rotation of the stepping motor is not performed in the case where print data immediately before and after stop of printing satisfy the above-mentioned first condition, and reverse rotation of the stepping motor is performed in the case where the corresponding print data do not satisfy the first condition (in other words, the corresponding print data satisfy the second condition), in both of cases where the corresponding print data satisfy the first condition or the second condition, it is possible to suppress occurrence of print omission. Also, since power is supplied to some heating elements of the plurality of heating elements of the head corresponding to dots designated by the print data of each of the lines L1 and L2, the number of dots of the corresponding print data is equal to the number of heating elements to which power is supplied based on the corresponding print data. As described above, the control unit 30 operates as a reverse-rotation control unit for determining whether to rotate the stepping motor 38 in the reverse direction to the rotation direction before pause of the operation of stepping motor 38, during pause, based on the state of the print data. In the above-described example, reverse rotation of the stepping motor is controlled based on print data before and after pause of printing. However, reverse rotation of the stepping motor 38 may be controlled based on other information such as the duration of pause of printing and the temperature of the print head 22 which is a thermal head. For example, as described above, in the case where change in the temperature of the head during pause is sufficiently small, in other words, in the case where the duration of pause of printing is relatively short and thus the temperature of the head is held within a certain range while the printing is paused, or in the case where power supply is appropriately performed while printing is paused, whereby the temperature of the head is held within a certain range while the printing is paused, since the print head 22 and the ink ribbon 14 (see FIG. 2 and FIG. 3) are unlikely to adhere to each other, if reverse rotation of the stepping motor 38 is performed, print omission can be suppressed. In other words, in the case where the control unit 30 determines that the temperature of the head will be held within a certain range during pause of printing, based on the duration of pause of printing and the printing control data for performing power supply control during pause of printing, reverse rotation is performed, whereas the case where the control unit 30 determines that the temperature of the head will not be held within a certain range during pause of printing, based on the duration of pause of printing and the printing control data for performing power supply control during pause of printing, reverse rotation is not performed. As described above, the control unit 30 operates as a reverse-rotation control unit for determining whether to rotate the stepping motor 38 in the reverse direction to the rotation direction before pause of the operation of stepping motor 38, during pause of the operation of stepping motor 38, based on the state of the printing control data. Therefore, occurrence of print omission can be effectively suppressed. To this end, in the present embodiment, the control unit 30 performs the above-described determining process based on the print data or the printing control data in STEP S607 and determines whether to perform reverse rotation in STEP S608.

Next, a detailed example of the motor reversing process of STEP S609 of the printing process according to the first embodiment illustrated by the flow chart of FIG. 6 will be described below. As described above, in the case where the control unit 30 performs control to rotate the stepping motor 38 in the reverse direction, the number of steps (the rotation amount) by which the stepping motor 38 is reversely rotated is important. Therefore, the appropriate number of steps should be applied to suppress print omission.

FIG. 7 is an explanatory view of the first embodiment and shows an experiment result representing whether print omission occurred in combinations of the tape widths (in millimeters) of print tapes 12 (shown in the longitudinal axis) detected as tape width detection signals by the tape width detection switches 29 of FIG. 3 and the numbers of reverse rotation steps "n" (shown in the transverse axis) during reverse rotation of the stepping motor 38. This experiment result corresponds to the case where the stepping motor 38 of FIG. 4 used 2-2 phase excitation drive and the gear ratio was two steps per one line (0.06 mm). In other words, the experiment result is the result in the case where conveyance by 0.03 mm was performed by one step, and the symbol "O" represents that any print omission did not occur, and the symbol "A" represents that sometimes print omission occurred, and the symbol "x" represents that print omission occurred every time. From this experiment result, it can be seen that when the tape width is between 24 mm and 46 mm, the case where the number of reverse rotation steps is four is optimal since any print omission does not occur, and when the tape width is between 12 mm and 18 mm, the case where the number of reverse rotation steps is six is optimal since any print omission does do not occur, and when the tape width is between 3.5 mm and 9 mm, the case where the number of reverse rotation steps is eight is optimal since any print omission does not occur.

Figures 8, 9:
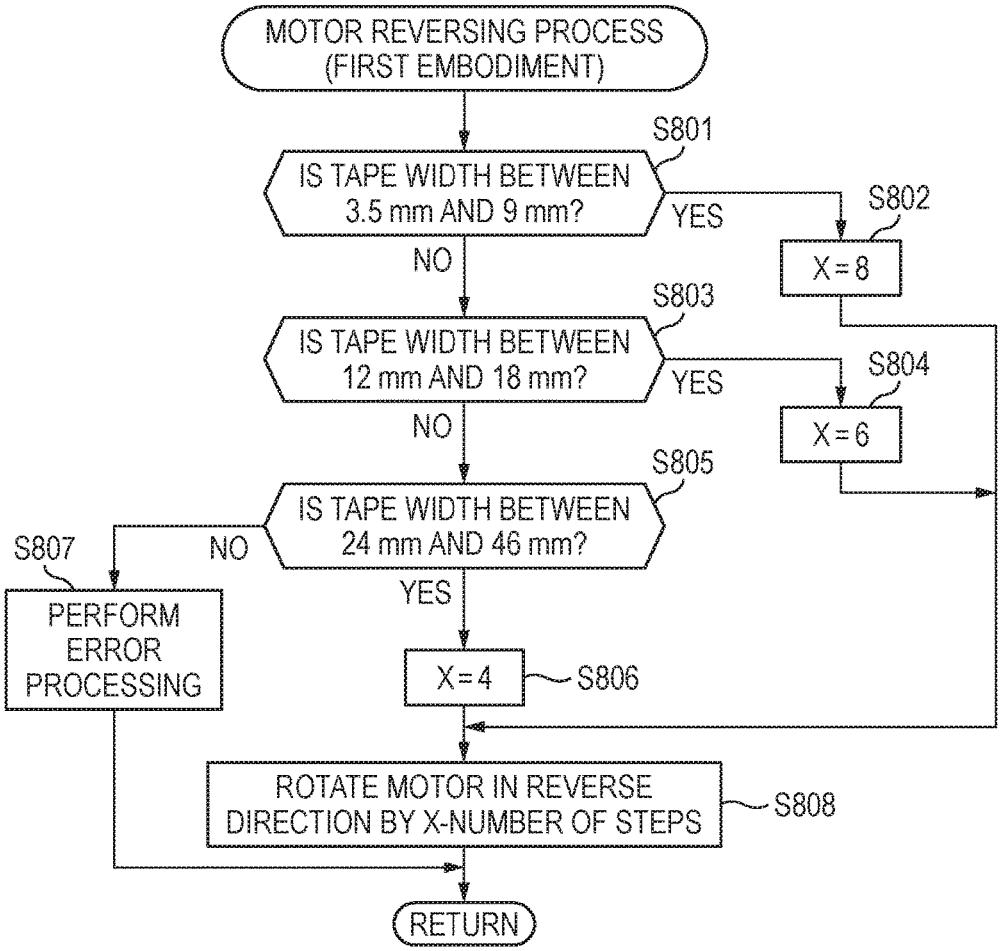
FIG. 8 is a flow chart illustrating the detailed processing of the motor reversing process according to the first embodiment.
FIG. 9 is an explanatory view of the detailed processing of a motor reversing process according to the second embodiment.

FIG. 8 is a flow chart illustrating detailed processing of the motor reversing process of STEP S609 in FIG. 6 according to the first embodiment which the control unit 30 performs based on the experiment result of FIG. 7. As described above, the print head 22 shown in FIG. 3 has a print width (a heating-element array length) corresponding to the largest tape width of various tape widths, and according to purposes, the user can set tape cassettes 10 having various tape widths between 24 mm and 46 mm, between 12 mm and 18 mm, or between 3.5 mm and 9 mm in the tape cassette storage part 5 of FIG. 1. As described above, the tape widths of tape cassettes 10 can be detected as tape width detection signals by the tape width detection switches 29.

The control unit 30 first determines whether the tape width of the print tape 12 detected as a tape width detection signal by the tape width detection switches 29 of FIG. 3 is between 3.5 mm and 9 mm (STEP S801 of FIG. 8). In the case where the determination of STEP S801 is "YES", the control unit 30 sets 8 as the value of the number of reverse rotation steps "X" to be held as a variable in the RAM 33 of FIG. 4 (STEP S802 of FIG. 8). Thereafter, the control unit 30 proceeds to the process of STEP S808.

In the case where the determination of STEP S801 is "NO", the control unit 30 determines whether the tape width is between 12 mm and 18 mm (STEP S803 of FIG. 8). In the case where the determination of STEP S803 is "YES", the control unit 30 sets 6 as the value of the number of reverse rotation steps "X" (STEP S804 of FIG. 8). Thereafter, the control unit 30 proceeds to the process of STEP S808.

In the case where the determination of STEP S803 is "NO", the control unit 30 determines whether the tape width is between 24 mm and 46 mm (STEP S805 of FIG. 8). In the case where the determination of STEP S803 is "YE", the control unit 30 sets 4 as the value of the number of reverse rotation steps "X" (STEP S806 of FIG. 8). Thereafter, the control unit 30 proceeds to the process of STEP S808.

In the case where the determination of STEP S805 is "NO", the control unit 30 determines that an improbable tape width has been detected, and performs error processing such as error display on the display unit 4 (STEP S807 of FIG. 8). Thereafter, the control unit 30 finishes the motor reversing process of STEP S609 of FIG. 6 illustrated by the flow chart of FIG. 8.

After the process of STEP S802, S804, or S806, the control unit 30 issues an instruction to the motor drive circuit 39 of FIG. 4 to rotate the stepping motor 38 in the reverse direction by the number of steps set as the variable "X" of the RAM 33 (STEP S808 of FIG. 8). Thereafter, the control unit 30 finishes the motor reversing process of STEP S609 of FIG. 6 illustrated by the flow chart of FIG. 8.

According to the detailed processing of the motor reversing process of STEP S609 of FIG. 6 as the flow chart of FIG. 8 in the first embodiment illustrated, it becomes possible to apply the optimal number of reverse rotation steps in the motor reversing process during restart after pause of printing, according to the tape width of the tape cassette 10 set by the user.

Next, a detailed example of the motor reversing process of STEP S609 of the printing process according to the second embodiment illustrated by the flow chart of FIG. 6 will be described below. If the resolution of the print head 22 increases, the number of heating elements increases, and there is a limit in current flowing in the whole of the heating elements due to the limitation of the power supply circuit and the like. In this case, since all heating elements cannot be heated at one time, a division printing technique for performing printing of one line while being divided into several times is used. In this case, the tape speed can be varied according to the number of divisions during division printing. FIG. 9 shows an experiment result representing whether print omission occurred in combinations of the numbers of divisions (shown along the longitudinal axis) and the numbers of reverse rotation steps "n" during reverse rotation of the stepping motor 38. The meanings of the symbols "A" and "x" are the same as those in the FIG. 7. According to the experiment result, when the number of divisions was 3 in all of cases where the number of reverse rotation steps "n" is 0, 2, or 4, any print omission did not occur. Meanwhile, when the number of divisions was 1, in cases where the number of reverse rotation steps "n" is 2 or 4, any print omission did not occur. From this, it is possible to establish a determination routine in which when the number of divisions is 3, the case where the number of reverse rotation steps "n" is 2 or greater is optimal since any print omission will not occur, and when the number of divisions is 1, the case where the number of reverse rotation steps "n" is 4 or greater is optimal since any print omission will not occur, with margin. Here, the case where the number of divisions is 3 corresponds to the case where printing is performed over the full width of the print head 22 is performed when the tape width is 46 mm, and the cases where the number of divisions is 1 or 2 correspond to the cases where the tape width is between 12 mm and 18 mm or between 3.5 mm and 9 mm, respectively. If these and the determination routine in the case of the first embodiment of FIG. 7 are combined, in the case where the tape width is between 3.5 mm and 24 mm, since the number of reverse rotation steps "n" becomes 4 or greater from the experiment result of FIG. 7, the optimal condition in the case where the number of divisions of FIG. 9 becomes 1 or 2 is satisfied, and thus it is unnecessary to consider the number of divisions. Only when the tape width is 46 mm, in the case where the number of divisions becomes 3, with margin for the experiment result of FIG. 9, the number of reverse rotation steps "n" may be set to 2, and in the case where the number of divisions becomes 1, with margin for the experiment result of FIG. 9, the number of reverse rotation steps "n" may be set to 4.

Figure 10:
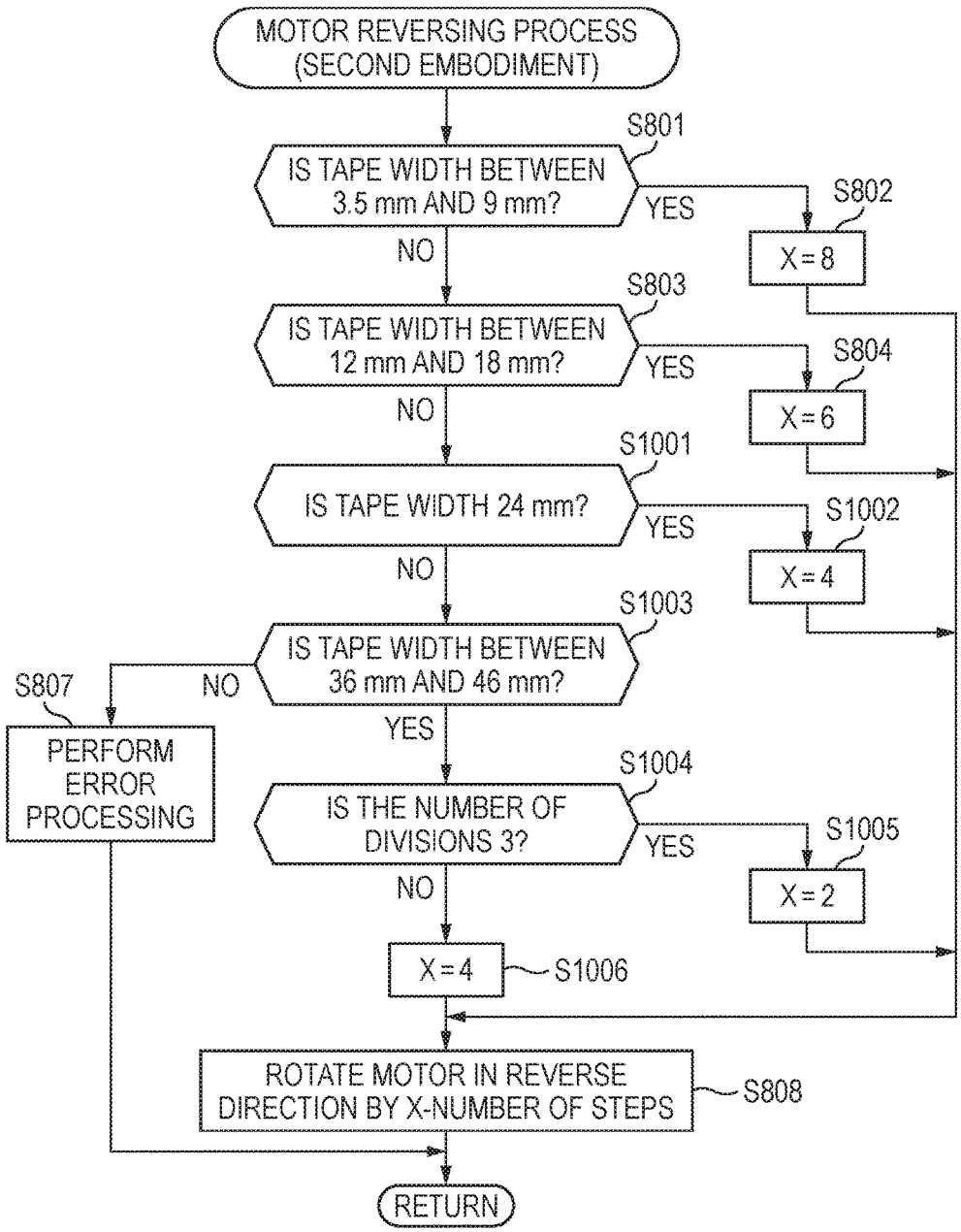
FIG. 10 is a flow chart illustrating the detailed processing of the motor reversing process according to the second embodiment.

FIG. 10 is a flow chart illustrating the detailed processing of the motor reversing process of STEP S609 in FIG. 6 according to the second embodiment which the control unit 30 performs based on the experiment results of FIG. 7 and FIG. 9. In FIG. 10, processes denoted by the step numbers as those in FIG. 8 are identical to the processes of FIG. 8. Therefore, processing from STEP S801 to STEP S804 in the cases where the tape width is between 12 mm and 18 mm or between 3.5 mm and 9 mm are the same as that in FIG. 8.

Subsequently, in the case where the determination of STEP S803 becomes "NO", the control unit 30 determines whether the tape width is 24 mm (STEP S1001). In the case where the determination of STEP S1001 is "YES", the control unit 30 sets 4 as the value of the number of reverse rotation steps "X" (STEP S1002 of FIG. 10). This is the same as STEP S806 of FIG. 8 of the first embodiment. Thereafter, the control unit 30 proceeds to the process of STEP S808.

If the determination of STEP S1002 is "NO", the control unit 30 determines whether the tape width is between 36 mm and 46 mm (STEP S1003). If the determination of STEP S1003 is "YES", the control unit 30 further determines whether the number of divisions of a line at this time (during pause of printing) applied to the print head drive circuit 37 of FIG. 4 is 3 (STEP S1004).

If the determination of STEP S1004 is "YES", the control unit 30 sets 2 as the number of reverse rotation steps "X" according to a determining process based on FIG. 9 (STEP S1005 of FIG. 10). Thereafter, the control unit 30 proceeds to the process of STEP S808.

If the determination of STEP S1004 is "YES", the control unit 30 sets 4 as the number of reverse rotation steps "X" according to a determining process based on FIG. 9 (STEP S1006 of FIG. 10). Thereafter, the control unit 30 proceeds to the process of STEP S808.

In the case where the determination of STEP S1003 is "NO", the control unit 30 determines that an improbable tape width has been detected and performs error processing such as error display on the display unit 4 (STEP S807 of FIG. 10), similarly in the case of FIG. 7. Thereafter, the control unit 30 finishes the motor reversing process of STEP S609 of FIG. 6 illustrated by the flow chart of FIG. 10.

After the process of STEP S802, S804, S1002, S1005, or S1006, the control unit 30 issues an instruction to the motor drive circuit 39 of FIG. 4 to rotate the stepping motor 38 in the reverse direction by the number of steps set as the variable "X" of the RAM 33 (STEP S808 of FIG. 10). Thereafter, the control unit 30 finishes the motor reversing process of STEP S609 of FIG. 6 illustrated by the flow chart of FIG. 10.

According to the detailed processing of the motor reversing process of STEP S609 of FIG. 6 in the second embodiment illustrated as the flow chart of FIG. 10, the optimal number of reverse rotation steps can be applied in the motor reversing process during restart after pause of printing, according to the number of divisions of division printing during printing of each line.

In the first and second embodiments described above, the print tapes 12 are various tapes having adhesive surfaces as the opposite surfaces to the print surfaces and having peelable tapes attached to the adhesive surfaces. However, the present invention is not limited thereto, and even if various tapes having exposed adhesive surfaces without peelable tapes attached to the adhesive surfaces are used as the print tapes 12, similarly in each embodiment, it is possible to effectively suppress print omission regardless of the patterns of print data.

As the tape widths and the numbers of divisions described in the first and second embodiments, various tape widths and various numbers of divisions can be applied.

In the first and second embodiments, the number of reverse rotation steps (the rotation speed) is controlled according to the tape width and the number of divisions of division printing. However, sensors for detecting the materials or colors of tapes may be installed such that it is possible to implement the same control according to the detection results of them.

With respect to the above-described embodiments, the following additional notes will be further disclosed.

1 printing apparatus
2 housing
3 keyboard input unit
4 display unit
5 tape cassette storage part
6 openable cover
10 tape cassette
11 cassette case
12 print tape
13 tape core
14 ink ribbon
15 ink ribbon supply core
16 ink ribbon winding core
17 print head insertion part
18 engagement part
20 cassette receiving part
22 print head
23 platen roller
24 tape core engagement shaft
25 ink ribbon winding drive shaft
26 tape discharge part
27 full-cutting mechanism
28 half-cutting mechanism
29 tape width detection switch
30 control unit (print data generating unit, printing-control-data generating unit, and reverse-rotation control unit)
32 ROM
33 RAM
35 display unit drive circuit
37 print head drive circuit
38 stepping motor (drive motor)
39 motor drive circuit
40 tape cut motor
41 cut motor drive circuit

The invention claimed is:

1. A printing apparatus comprising:
a print head configured to perform printing on a print medium line by line based on print data;
a drive motor configured to convey the print medium in accordance with printing of the print data on the print medium;
a processor; and
a width detecting unit configured to detect width information of the print medium,
wherein in a case where printing is restarted after printing on the print medium by the print head is paused, the processor controls a rotation direction of the drive motor to be a reverse direction opposite to a direction before the pause of the printing and determines a rotation amount of the reverse rotation according to the width information of the print medium detected by the width detecting unit.

2. The printing apparatus according to claim 1,
wherein the processor determines the rotation amount of the reverse rotation to be larger as the width information of the print medium detected by the width detecting unit is smaller.

3. A printing apparatus comprising:
a print head configured to perform printing on a print medium line by line based on print data;
a drive motor configured to convey the print medium in accordance with printing of the print data on the print medium; and
a processor,
wherein in a case of performing printing on the print medium line by line by the print head, the processor controls the print head to perform printing of one line based on the print data while dividing the printing of the one line into a plurality of divisions, and
wherein in a case where printing is restarted after printing on the print medium by the print head is paused, the processor controls a rotation direction of the drive motor to be a reverse direction opposite to a direction before the pause and determines a rotation amount of the reverse rotation according to a number of the plurality of divisions of the printing of the one line.

4. The printing apparatus according to claim 3, further comprising:
a width detecting unit configured to detect width information of the print medium,
wherein when the processor controls the rotation direction of the drive motor during the pause of the printing to be the reverse direction, the processor determines the rotation amount of the reverse rotation according to the number of the plurality of divisions of the printing of the one line and the width information of the print medium detected by the width detecting unit.

5. The printing apparatus according to claim 4,
wherein the processor determines the rotation amount of the reverse rotation to be larger as the width of the print medium based on the width information detected by the width detecting unit is smaller, and wherein in a case where the width of the print medium detected by the width detecting unit is equal to or larger than a predetermined width, the processor sets the rotation amount of the reverse rotation to be smaller as the number of the plurality of divisions of the printing of the one line is larger.

6. A control method of a printing apparatus which includes a print head configured to perform printing on a print medium line by line based on print data, a drive motor configured to convey the print medium in accordance with printing of the print data on the print medium, a processor, and a width detecting unit configured to detect width information of the print medium, the method comprising:

in a case where printing is restarted after printing on the print medium by the print head is paused, controlling, by the processor, a rotation direction of the drive motor to be a reverse direction opposite to a direction before the pause of the printing, and determining, by the processor, a rotation amount of the reverse rotation according to the width information of the print medium detected by the width detecting unit.

7. A non-transitory computer-readable recording medium storing a program which is executable by a computer of a printing apparatus including a print head configured to perform printing on a print medium line by line based on print data for printing on the medium, a drive motor configured to convey the print medium in accordance with printing of the print data on the print medium, and a width detecting unit configured to detect width information of the print medium, the program, when executed by the computer, controlling the computer to:

in a case where printing is restarted after printing on the print medium by the print head is paused, control a rotation direction of the drive motor to be a reverse direction opposite to a direction before the pause of the printing, and determine a rotation amount of the reverse rotation according to the width information of the print medium detected by the width detecting unit.

* * * * *